US007217170B2

(12) United States Patent
Moll et al.

(10) Patent No.: US 7,217,170 B2
(45) Date of Patent: May 15, 2007

(54) TRANSFORMABLE TOY VEHICLE

(75) Inventors: Joseph T. Moll, Redondo Beach, CA (US); Vladimir Leonov, San Pedro, CA (US); William Willett, Irvine, CA (US); Kenlip Ong, Singapore (SG)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/223,132

(22) Filed: Sep. 9, 2005

(65) Prior Publication Data

US 2006/0089080 A1 Apr. 27, 2006

Related U.S. Application Data

(60) Provisional application No. 60/642,060, filed on Jan. 7, 2005, provisional application No. 60/622,037, filed on Oct. 26, 2004.

(51) Int. Cl.
*A63H 23/04* (2006.01)
*A63H 17/00* (2006.01)
*A63H 17/267* (2006.01)

(52) U.S. Cl. ..... 446/164; 446/462; 446/465; 446/470

(58) Field of Classification Search ..... 446/153, 446/154, 160, 164, 456, 462, 465, 470
See application file for complete search history.

(56) References Cited

U.S. PATENT DOCUMENTS 2,104,636 A 1/1938 Burcham
2,372,043 A 3/1945 Aghnides
2,949,697 A 8/1960 Licitis et al.
3,312,013 A 4/1967 Graves
3,327,796 A 6/1967 Hanmer
3,500,579 A 3/1970 Bryer
3,555,725 A 1/1971 Orfei et al.
3,667,156 A 6/1972 Tomiyama et al.
3,722,134 A 3/1973 Merrill et al.
3,733,739 A 5/1973 Terzian
3,746,117 A 7/1973 Alred (Continued)

FOREIGN PATENT DOCUMENTS

DE 88 03 308.2 U1 6/1988

(Continued)

OTHER PUBLICATIONS

Mattel, *Mattel 2003 Catalogue*, 2 pages (2003).

*Primary Examiner*—John A. Ricci
(74) *Attorney, Agent, or Firm*—Akin Gump Strauss Hauer & Feld LLP

(57) ABSTRACT

A toy vehicle includes a central housing having first and second oppositely disposed sides. A first wheel is rotatably mounted on the first side of the housing, and a second wheel is rotatably mounted on the second side of the housing. Each of the first and second wheels has a central hub and a plurality of individual vanes rotatably attached to the hub. Each hub has a center disposed along a first axis of rotation. Each vane is rotatable about a second vane axis extending transversely with respect to the first axis. An end of each vane distal to the hub forms a circumferential surface portion of one of the first and second wheels.

36 Claims, 10 Drawing Sheets

U.S. PATENT DOCUMENTS

| | | | | |
|---|---|---|---|---|
| 3,798,835 | A | | 3/1974 | McKeehan |
| 3,893,707 | A | | 7/1975 | Samsel |
| 4,057,929 | A | | 11/1977 | Ogawa |
| 4,143,484 | A | * | 3/1979 | Yonezawa ..... 446/278 |
| 4,300,308 | A | | 11/1981 | Ikeda |
| D262,224 | S | | 12/1981 | Aoki |
| 4,310,987 | A | | 1/1982 | Chieffo |
| 4,386,787 | A | | 6/1983 | Maplethorpe et al. |
| 4,391,224 | A | | 7/1983 | Adler |
| 4,438,588 | A | | 3/1984 | Martin |
| 4,471,567 | A | | 9/1984 | Martin |
| 4,501,569 | A | | 2/1985 | Clark, Jr. et al. |
| 4,505,346 | A | | 3/1985 | Mueller |
| 4,541,814 | A | | 9/1985 | Martin |
| 4,568,306 | A | | 2/1986 | Martin |
| 4,599,077 | A | | 7/1986 | Vuillard |
| 4,601,675 | A | | 7/1986 | Robinson |
| 4,609,196 | A | | 9/1986 | Bozinovic |
| 4,666,420 | A | | 5/1987 | Nagano |
| 4,671,779 | A | | 6/1987 | Kurosawa |
| 4,680,022 | A | * | 7/1987 | Hoshino et al. ..... 446/487 |
| 4,693,696 | A | | 9/1987 | Buck |
| 4,726,800 | A | | 2/1988 | Kobayashi |
| 4,773,889 | A | | 9/1988 | Rosenwinkel et al. |
| 4,892,503 | A | | 1/1990 | Kumazawa |
| 4,897,070 | A | | 1/1990 | Wagstaff |
| 4,927,401 | A | | 5/1990 | Sonesson |
| 5,041,051 | A | | 8/1991 | Sonesson |
| 5,131,882 | A | | 7/1992 | Kiyokane |
| 5,439,408 | A | | 8/1995 | Wilkinson |
| 5,487,692 | A | | 1/1996 | Mowrer et al. |
| 5,533,921 | A | | 7/1996 | Wilkinson |
| 5,618,219 | A | | 4/1997 | Simone et al. |
| 5,667,420 | A | | 9/1997 | Menow et al. |
| 5,692,946 | A | | 12/1997 | Ku |
| 5,769,441 | A | | 6/1998 | Namngani |
| 5,871,386 | A | | 2/1999 | Bart et al. |
| 5,919,075 | A | | 7/1999 | George et al. |
| 6,024,627 | A | | 2/2000 | Tilbor et al. |
| 6,066,026 | A | | 5/2000 | Bart et al. |
| 6,095,890 | A | | 8/2000 | George et al. |
| 6,129,607 | A | | 10/2000 | Hoeting et al. |
| 6,227,934 | B1 | | 5/2001 | Isaksson et al. |
| 6,439,948 | B1 | | 8/2002 | Ostendorff et al. |
| 6,458,008 | B1 | | 10/2002 | Hyneman |
| 6,475,059 | B1 | | 11/2002 | Lee |
| 6,502,657 | B2 | | 1/2003 | Kerrebrock et al. |
| 6,540,583 | B1 | | 4/2003 | Hoeting et al. |
| 6,648,722 | B2 | | 11/2003 | Lynders et al. |
| 6,752,684 | B1 | | 6/2004 | Lee |
| 6,764,374 | B2 | | 7/2004 | Tilbor et al. |

FOREIGN PATENT DOCUMENTS

| | | | |
|---|---|---|---|
| FR | 2 539 904 | A1 | 7/1984 |
| GB | 1 292 441 | A | 10/1972 |
| JP | 59-167584 | U | 11/1984 |
| JP | 61-139288 | U | 8/1986 |

* cited by examiner

TRANSFORMABLE TOY VEHICLE

CROSS-REFERENCE TO RELATED APPLICATIONS

This patent application claims priority to U.S. Provisional Patent Application Nos. 60/622,037, filed Oct. 26, 2004, and 60/642,060, filed Jan. 7, 2005, each entitled "FLIPOUT RC-Generally Spherical Transforming Toy Vehicle", the disclosures of which are incorporated by reference herein in their entireties.

BACKGROUND OF THE INVENTION

The present invention relates to toy vehicles, particularly those having unusual transforming characteristics.

BRIEF SUMMARY OF THE INVENTION

Briefly stated, the present invention is a toy vehicle comprising a central housing having first and second oppositely disposed sides. A first wheel is rotatably mounted on the first side of the housing, and a second wheel is rotatably mounted on the second side of the housing. Each of the first and second wheels has a central hub and a plurality of individual vanes rotatably attached to the hub. Each hub has a center disposed along a first axis of rotation. Each vane is rotatable about a second vane axis extending transversely with respect to the first axis. An end of each vane distal to the hub forms a circumferential surface portion of one of the first and second wheels.

In another aspect, the present invention is a transformable toy vehicle for movement on a surface. The toy vehicle comprises a housing. At least two reconfigurable wheels are mounted on the housing for rotation about a common axis extending through the housing. Rotation of the wheels causes the toy vehicle to move on the surface. Each of the two wheels has at least a first configuration in which the wheel is generally shaped to receive and surround a portion of the housing adjoining the wheel and at least a second configuration different from the first configuration. A tail is movably engaged with the housing. The tail has at least a first end and an oppositely disposed, free second end. The tail is movable between an extended position with at least the free end extending beyond an imaginary cylinder having a cross-section defined by circumferential perimeters of the two wheels in all possible configurations of the two wheels and a retracted position with the free end closer to the housing.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
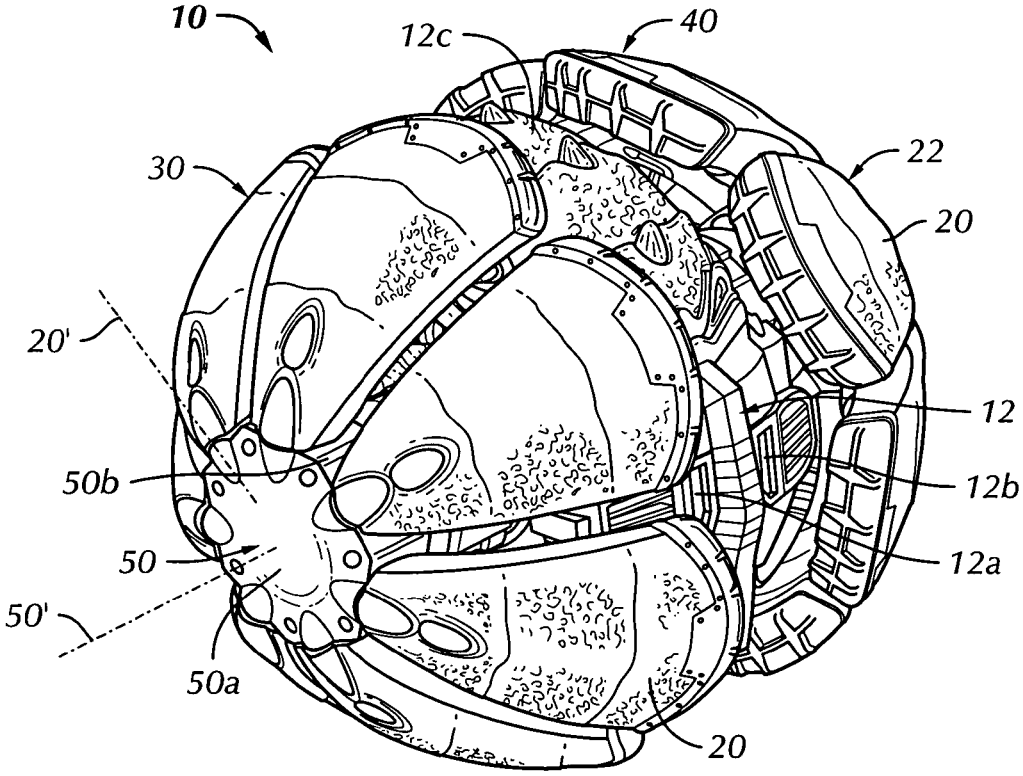
FIG. 1 is a front left perspective view of a toy vehicle, in accordance with a preferred embodiment of the present invention, having vanes in a first position and a tail in a retracted position.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

Referring to the drawings in detail, wherein like numerals indicate like elements throughout, there is shown in FIGS. 1–10 a preferred embodiment of a transformable toy vehicle, indicated generally at 10, in accordance with the present invention, in a generally spherical configuration for movement on a surface (not shown). Referring initially to FIG. 1, the toy vehicle 10 includes a central housing 12, preferably having first and second oppositely disposed sides 12*a*, 12*b*. The central housing 12 preferably also includes a front cover 12*c* which is engaged with the first and second sides 12*a*, 12*b*. While this is preferred, it is within the spirit and scope of the present invention that the front cover 12*c* be omitted, leaving only the first and second sides 12*a*, 12*b*, provided the toy vehicle 10 is still capable of functioning as described herein.

The toy vehicle 10 preferably includes at least two reconfigurable "wheels" rotatably engaged with the central housing 12. Specifically, a first "wheel" 30 is rotatably mounted on the first side 12*a* of the housing 12, and a second "wheel" 40 is rotatably mounted on the second side 12*b* of the housing 12. Rotation of the first and second "wheels" 30, 40 causes the toy vehicle 10 to move on the surface.

Figure 2:
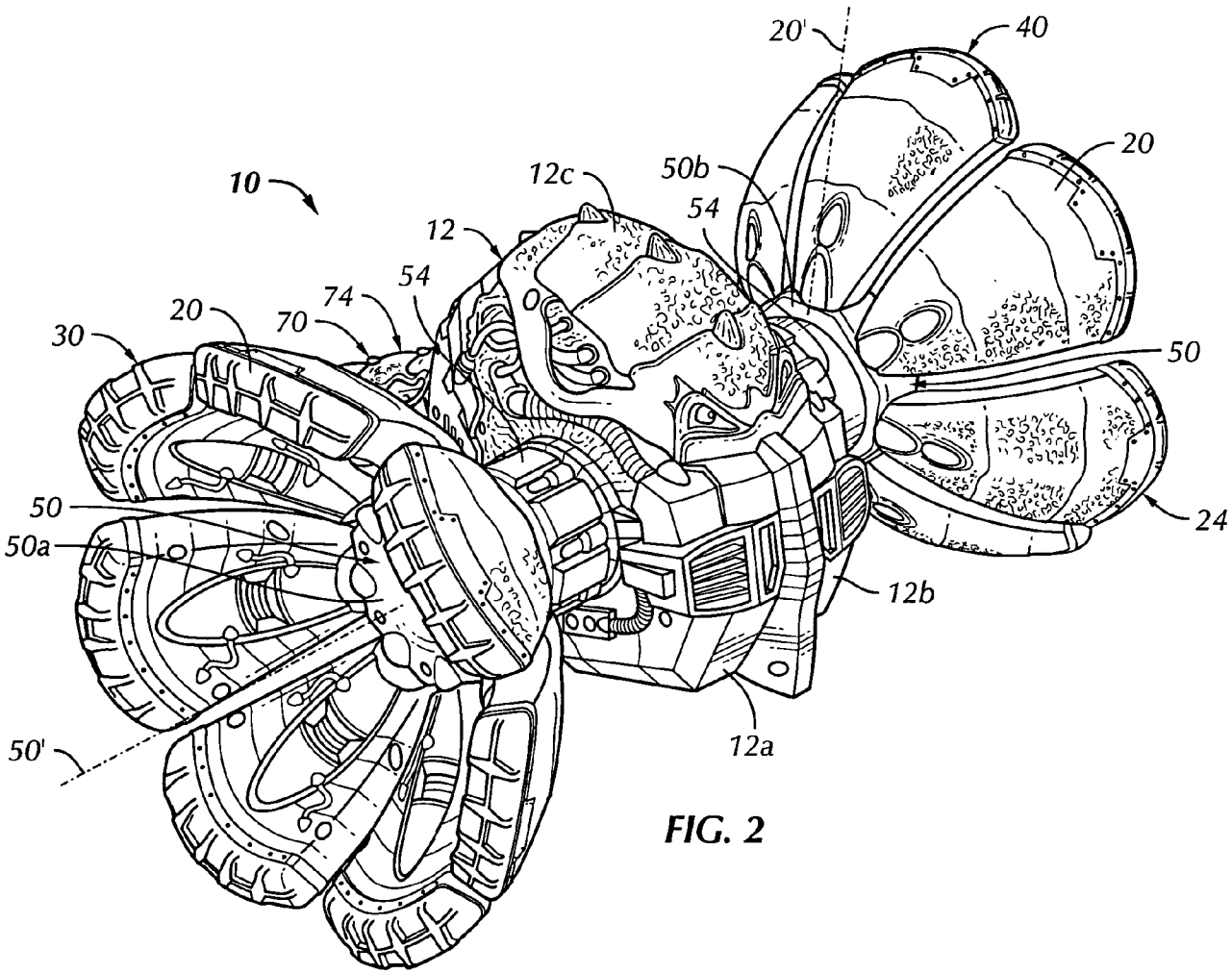
FIG. 2 is a front left perspective view of the toy vehicle of FIG. 1 having the vanes in a second position and the tail in an extended position.
Figure 3:
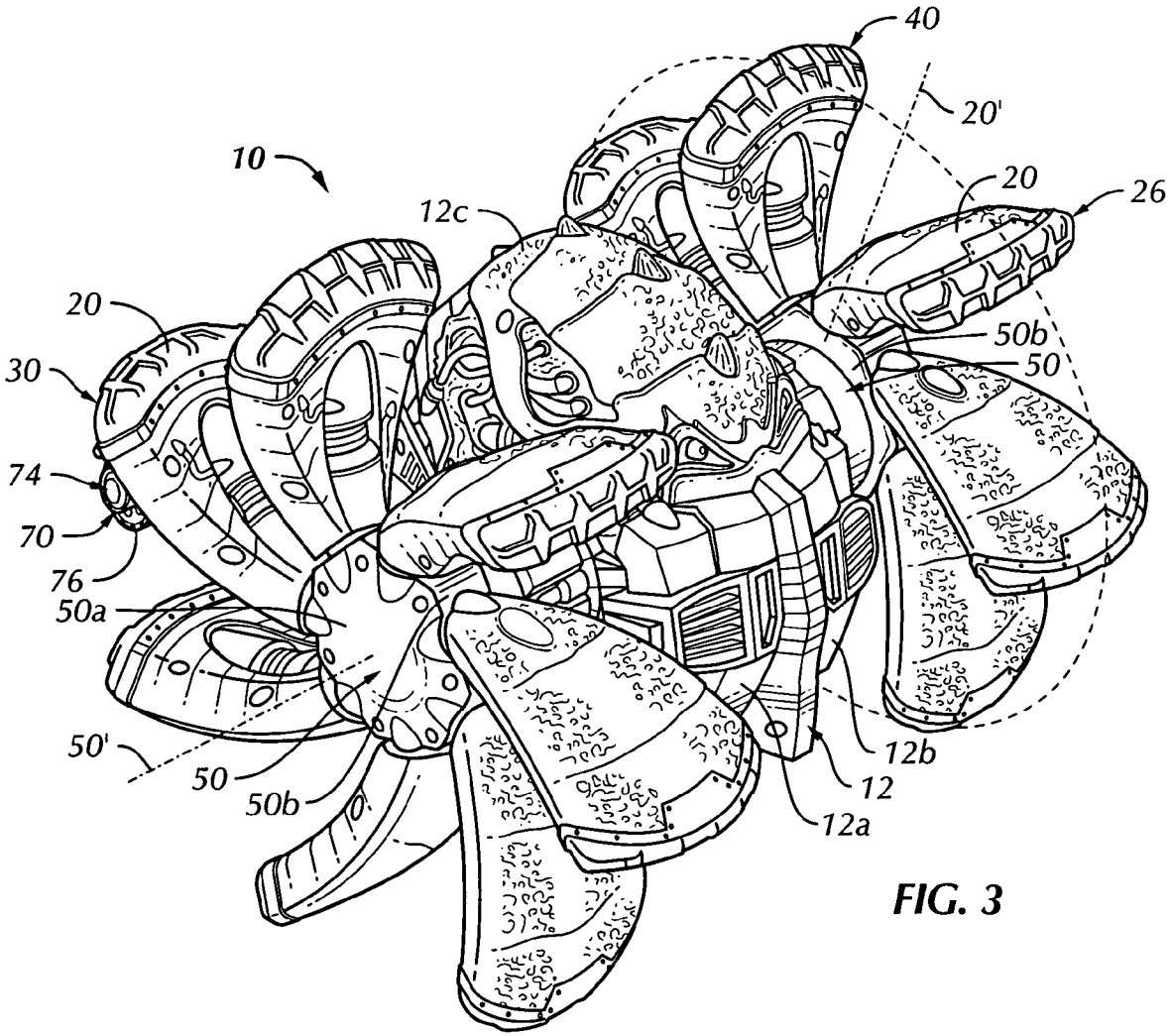
FIG. 3 is a front left perspective view of the toy vehicle of FIG. 2 having the vanes in an intermediate rotational position and the tail in the extended position.

Referring now to FIGS. 1–3, each of the first and second "wheels" 30, 40 has a central hub 50 and a plurality of individuals vanes 20 rotatably attached to the hub 50. Preferably, each hub 50 has seven vanes 20 rotatably attached thereto, circumferentially disposed around the hub 50, although it is within the spirit and scope of the present invention that there be more or less than seven vanes 20, provided the toy vehicle 10 is still capable of functioning as described herein. Each vane 20 has a length much greater than its thickness and flares in width as it extends away from the hub 50. Each vane 20 is preferably at least slightly curved along a longitudinal axis thereof and transversely in the width direction. Each hub 50 has a center generally disposed along a first axis of rotation 50'. As will be described below, the first and second wheels 30, 40, including their respective hubs 50, are rotatable with respect to the central housing 12, such that the first and second wheels 30, 40 rotate about the first axis of rotation 50'. Each vane 20 is further rotatable about a second vane axis 20' extending transversely and preferably generally radially from the first axis 50'.

Preferably, the vanes 20 are rotatable about the individual second axes 20' between a first position 22 (FIG. 1) and a second position 24 (FIG. 2) rotationally different from the first position 22. Because the vanes 20 are curved, in the first position 22, the first and second wheels 30, 40 are generally cupped with open ends directed inwardly toward one another and the central housing 12, such that the central housing 12 is at least partially received in the first and second wheels 30, 40, partially covered by the vanes 20, and the toy vehicle 10 is generally spherical in shape. In the second position 24, the first and second wheels 30, 40 are generally cupped with the open ends directed outwardly away from one another and the central housing 12, thereby exposing at least a majority of the central housing 12. It is preferable that the first and second wheels 30, 40 are generally hemispherical in the first and second positions 22, 24, although it is within the spirit and scope of the present invention that the first and second wheels 30, 40 have shapes other than generally hemispherical, such as semi-ovoid or conical, provided the toy vehicle is capable of functioning as described herein. Moreover, the vanes do not have to be cupped but may, instead, be essentially straight or curved in only one direction. Furthermore, the vanes can be configured and sized to fully surround the central housing 12, if desired.

It is preferred that the first and second wheels 30, 40, and specifically the vanes 20 thereof, are rotatable about 180° between the first and second positions 22, 24, and further can be oriented in at least one intermediate rotational position 26 between the first and second positions 22, 24. Preferably, the vanes 20 can be oriented at least to an intermediate position 26 rotationally halfway between the first and second positions 22, 24, such that the first and second wheels 30, 40 generally resemble paddle wheels, as shown in FIG. 3, to facilitate travel of the toy vehicle 10 on water or soft surfaces such as snow, sand, etc. While this is the preferred intermediate position 26, it is preferred that the vanes 20 be capable of being maintained in any desired rotational position between the first and second positions 22, 24, such that the first and second wheels 30, 40 essentially have an unlimited number of intermediate positions. Preferably, the vanes 20 are linked together in each wheel 30, 40 so as to rotate in unison, as will be described in more detail below.

Figure 4:
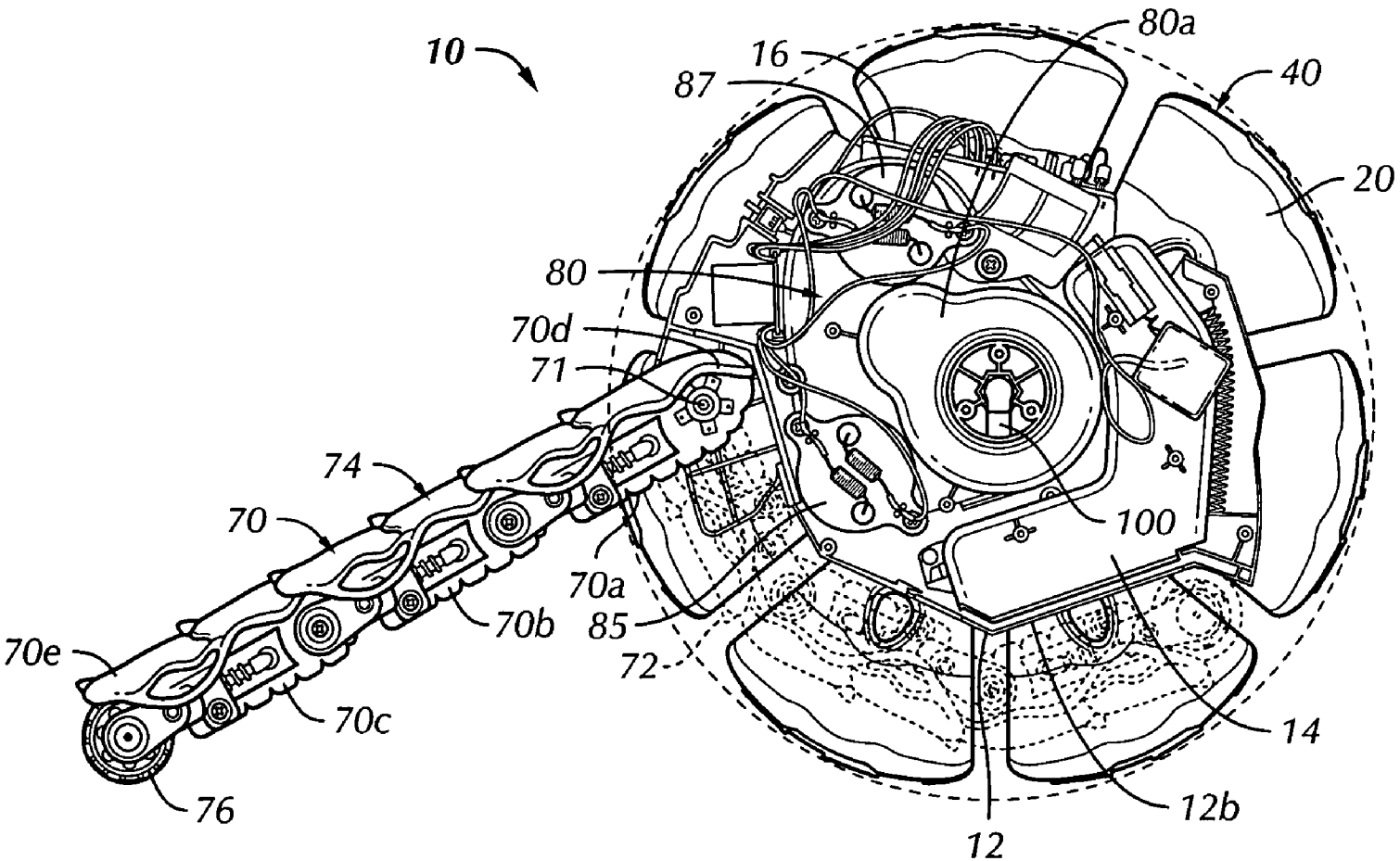
FIG. 4 is a left elevational view of the toy vehicle of FIG. 2 having a first wheel and a first side of a central housing omitted to expose an on-board control unit, a battery housing, and a gear housing within the central housing.

Referring to FIGS. 2 and 4, the toy vehicle 10 further includes a tail 70 preferably movably engaged with the central housing 12. Preferably, the tail 70 has at least a first end 70*d* secured to the remainder of the toy vehicle 10 and an oppositely disposed, free second end 70*e*. It is preferred that the first end 70*d* of the tail 70 is pivotably attached to the central housing 12 by suitable means, such as a pin 71. The tail 70 preferably has a retracted position 72 (shown in phantom in FIG. 4) and an extended position 74. The tail 70 is preferably flexible, such that the tail 70, in the retracted position 72, is generally wrapped around the central housing 12 and, in the extended position 74, the tail 70 extends outwardly from the central housing 12 so that at least the second end 70*e* is spaced from the central housing 12 and beyond an imaginary cylinder having a cross-section defined by circumferential perimeters, indicated in phantom in FIGS. 3 and 4, of the two wheels 30, 40, preferably in all possible configurations of the vanes 20. Preferably, the tail 70 is formed by at least two articulated segments 70*a*, 70*b*, such that a first segment 70*a* is rotatably coupled to the central housing 12 and at least a second segment 70*b* is rotatably coupled to the first segment 70*a*. More specifically, it is preferable that the tail 70 is formed by at least three segments with the first segment 70*a* rotatably coupled to the central housing 12, the second segment 70*b* rotatably coupled to the first segment 70*a*, and a third segment 70*c* rotatably coupled to the second segment 70*b*. Although it is preferred to have an articulated tail, it is within the spirit and scope of the present invention that the tail 70 be made flexible in other ways. For example, the tail could be provided by a spring member that is partially coiled around the central housing and that resiliently reacts to uncoiling. Also, the tail need not be flexible. It may be relatively rigid and coupled with the central housing to be always extended or movably mounted to be controllably extended and retracted.

Preferably, when in the retracted position 72, the tail 70 is disposed between open ends of the first and second wheels 30, 40 with the vanes 20 in the first position 22, such that the toy vehicle 10 is generally spherical or, alternatively, generally ovular in shape. Preferably, the tail 70 includes at least one tail wheel 76 proximate the second end 70*e* for contacting a surface (not shown) in at least the extended position 74 of the tail 70. The tail wheel 76 is preferably rotatably coupled to the second end 70*e* of the tail 70 so as to roll along the surface during movement of the toy vehicle 10. Although only one tail wheel 76 is shown, it is within the spirit and scope of the present invention that there be more than one wheel or, alternatively, no wheels on the tail 70, such that the second end 70*e* of the tail 70 merely slides along the surface during movement of the toy vehicle 10.

If desired, the tail 70 and the vanes 20 of the first and second wheels 30, 40 can be made buoyant in water. Buoyancy of the tail 70 and vanes 20 can be accomplished in any number of ways, including, but not limited to, forming the tail 70 and vanes 20 of generally hollow, sealed, shell-like forms and/or making the tail 70 and the vanes 20 at least partially from a plastic foam material. Although these methods of making the tail 70 and the vanes 20 buoyant are preferred, they are not meant to be limiting, as it is within the spirit and scope of the present invention for the tail 70 and the vanes 20 to be made buoyant in another manner that is generally known to one skilled in the art or to be made non-buoyant for use of the toy vehicle only on solid surfaces. By constructing the vanes 20 and the tail 70 in a manner so that the vanes 20 and tail 70 are buoyant, the toy vehicle 10 can be made capable of traveling along the surface of the water, if so desired.

Referring to FIG. 4, preferably, a gear housing 80 is disposed within the central housing 12 and includes first and second portions 80*a*, 80*b*. Preferably, the central housing 12 is also an outer housing and is decorated in some manner so as to be visually interesting to a user. For instance, the outer housing 12 can be decorated to resemble an animal, a monster, or an insect, although this is not intended to be limiting. As such, it is within the spirit and scope of the present invention that the outer housing 12 be decorated in any manner. Optionally, the outer housing 12 could be omitted and the gear housing 80 could be used as the central housing of the toy vehicle, without a separate outer housing or cover (partial outer housing) and with or without decoration.

Referring now to FIGS. 5–8, preferably, housed within the gear housing 80 are first and second drive gear trains 82, 84 and a transformation gear train 86. The first and second drive gear trains 82, 84 and the transformation gear train 86 are preferably reduction gear trains. Preferably, the first drive gear train 82 is operatively coupled to the first wheel 30. The second drive gear train 84 is operatively coupled to the second wheel 40. The transformation gear train 86 is operatively coupled with a central shaft assembly 90 that is at least partially housed within the gear housing 80. Preferably, at least a first preferably reversible motor 83 is operatively coupled to at least the first wheel 30 through the first drive gear train 82 to drive at least the first wheel 30, and at least a second preferably reversible motor 85 is operatively coupled to at least the second wheel 40 through the second drive gear train 84 to drive at least the second wheel 40. More specifically, it is preferred that pinions 83*a*, 85*a* of the first and second motors 83, 85 mesh with the first and second drive gear trains 82, 84, respectively, such that the first and second motors 83, 85 separately and independently drive the first and second wheels 30, 40. In this way, the first and second wheels 30, 40 can be driven in the same direction to move the toy vehicle 10 in either a forward or backward direction. The first and second wheels 30, 40 can also be driven in opposite directions to quickly turn the toy vehicle 10 in place about its center to either the left or the right. Alternatively, only one of the first and second wheels 30, 40 can be driven (the other of the first and second wheels 30, 40 being undriven) so as to turn the toy vehicle 10 generally about the undriven wheel more slowly than if the first and second wheels 30, 40 are driven in opposite directions.

Figure 5:
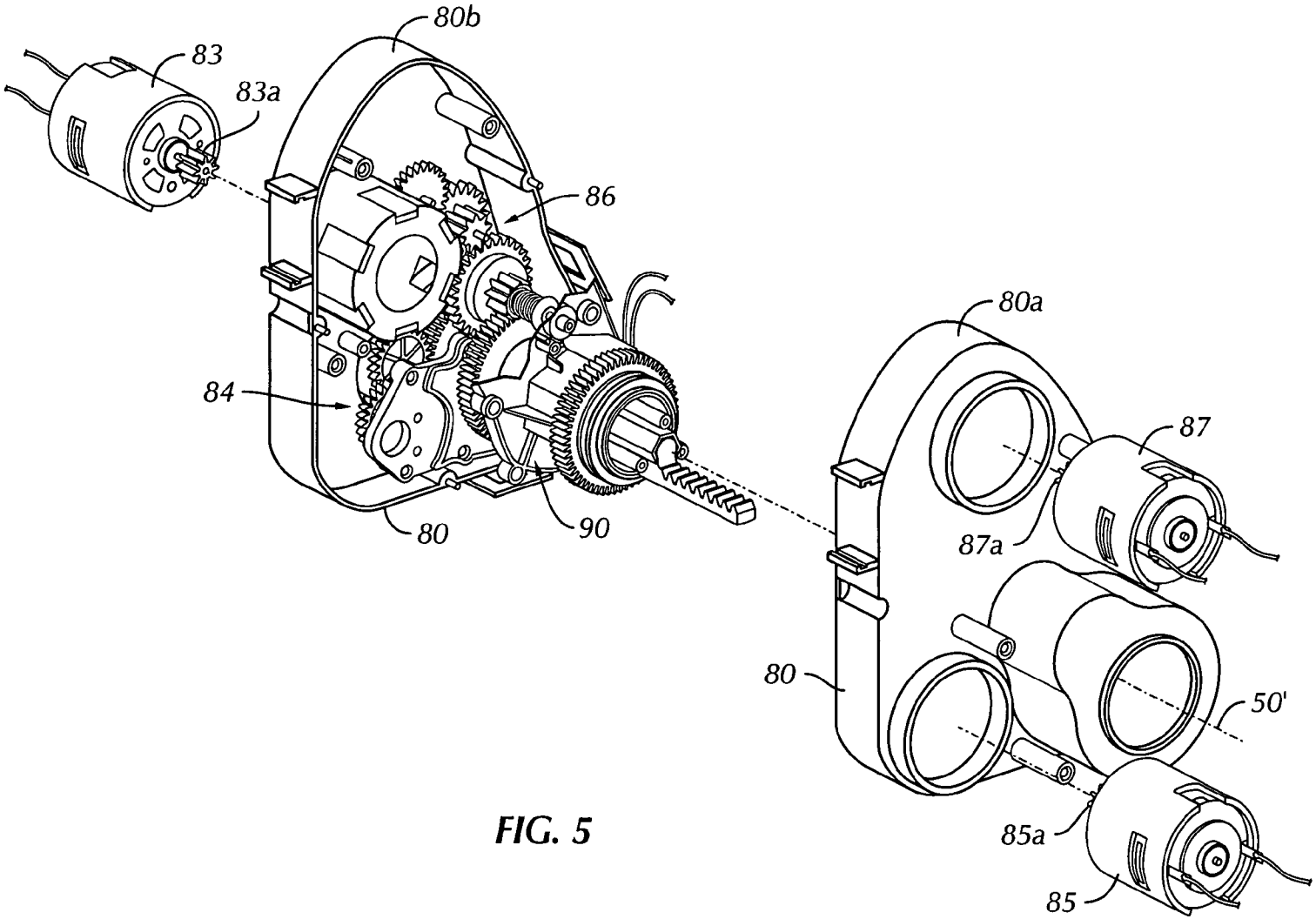
FIG. 5 is a partially exploded view of the gear housing of FIG. 4.
Figure 7:
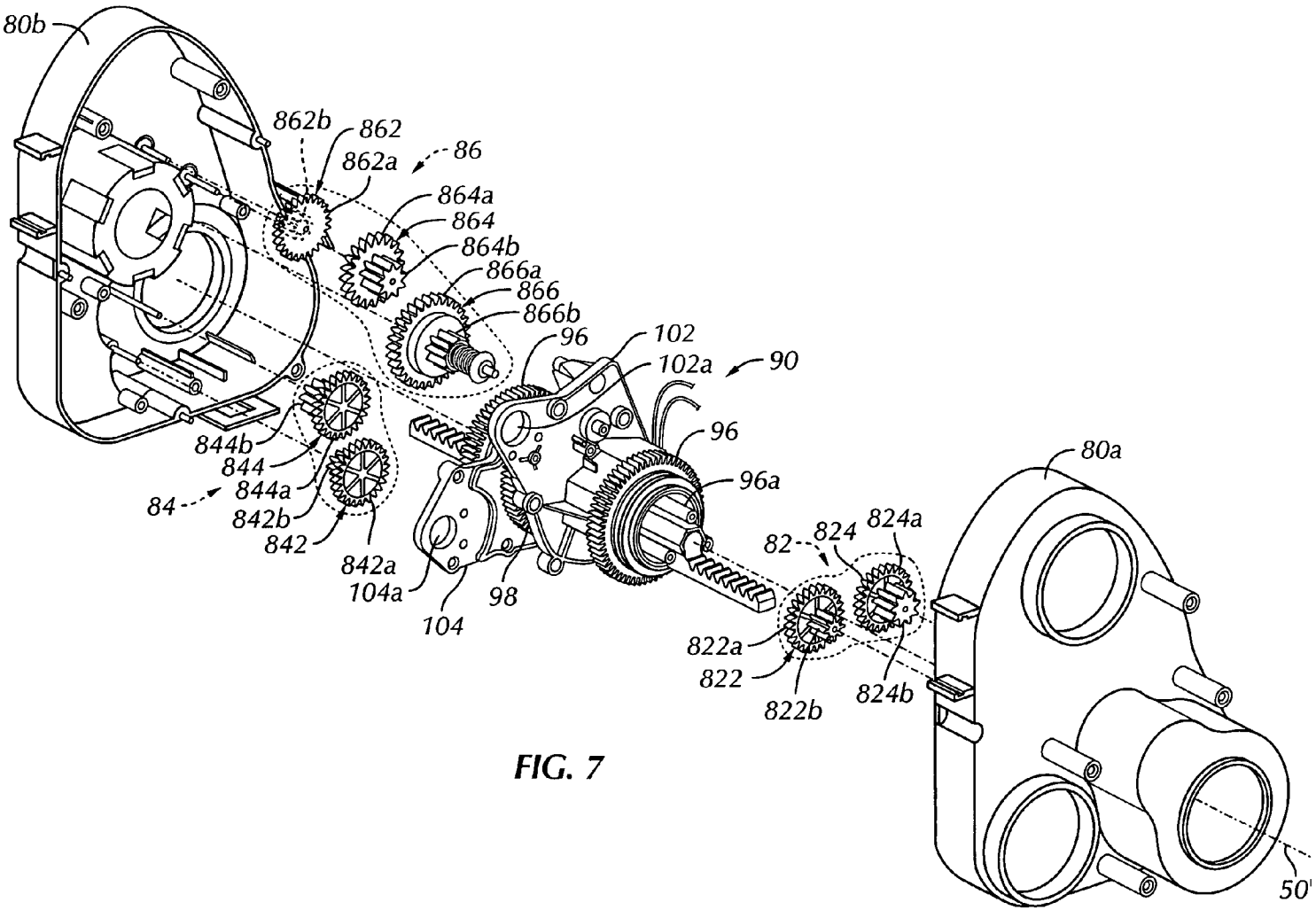
FIG. 7 is an exploded view of the gear housing of FIG. 4.

Referring specifically to FIGS. 5 and 7, the first and second drive gear trains 82, 84 are essentially similar. As such, only the first drive gear train 82 will be described in detail. The first motor 83 is preferably secured to the second portion 80*b* of the gear housing 80 such that the pinion 83*a* of the first motor 83 extends through the second portion 80*b* and through an opening 102*a* in an innermost first cover 102 and meshes with a first spur portion 822*a* of a first compound gear 822 of the first drive gear train 82. A smaller, second spur portion 822*b* of the first compound gear 822 meshes with a first spur portion 824*a* of a second compound gear 824. A second smaller spur portion 824*b* of the second compound gear 824 then meshes with a drive gear 96, which, as will be described in more detail below, is part of the central shaft assembly 90 and is coupled with the first wheel 30. In this way, the first motor 83 is able to power the first wheel 30 through the first drive gear train 82. In a like manner, the second motor 85 is able to power the second wheel 40 through the second drive gear train 84, in order to separately and independently drive the first and second wheels 30, 40.

It is preferred that at least one of the first and second compound gears 822, 824 of the first drive gear train include a clutch (not shown) therein in order to limit damage of the first drive gear train 82 and/or the first motor 83 should the first wheel 30 be stopped or otherwise held up during driving thereof. Preferably, the second compound gear 824 includes the clutch. While the clutch is not shown in detail, such clutches are well known in the art. Preferably, the clutch included with the second compound gear 824 is a generally circular leaf spring disposed between the separate first and second spur portions 824*a*, 824*b*, which allows rotation of the first spur portion 824*a* with respect to the second spur portion 824*b* when a certain threshold torque is reached, the threshold torque generally being the amount of torque experienced by the second compound gear 824 when the first wheel 30 is powered but unable to move.

Referring again to FIGS. 5–8, the transformation gear train 86 is preferably disposed partially within the second portion 80*b* of the gear housing 80 and is driven by a third preferably reversible motor 87, which is preferably engaged with the first portion of the gear housing 80. As will be described below, the transformation gear train 86 is operatively coupled to the vanes 20 of the first and second wheels 30, 40. In turn, the third motor 87 is operatively coupled to the vanes 20 in order to rotate the vanes 20 to transform the toy vehicle 10 by rotating the vanes 20 about the vane axes 20' between at least the first and second positions 22, 24.

Figure 6:
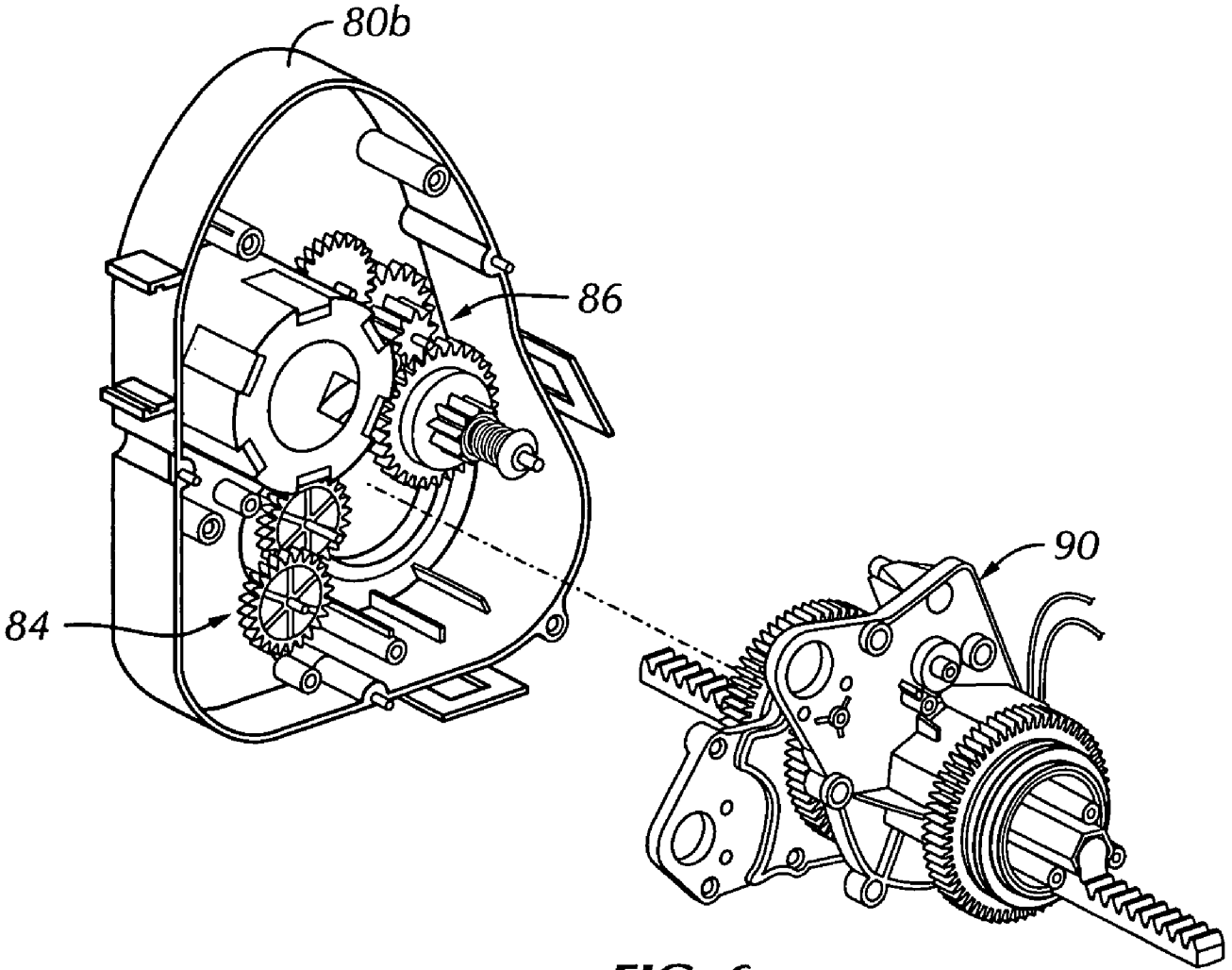
FIG. 6 is a partially exploded view of the gear housing of FIG. 5 having motors and the first portion of the gear housing omitted.

Referring specifically to FIGS. 5–7, a pinion 87*a* of the third motor 87 meshes with a first spur portion 862*a* of a first compound gear 862. A second, smaller spur portion 862*b* of the first compound gear 862 meshes with a first spur portion 864*a* of a second compound gear 864. A second, smaller spur portion 864*b* of the second compound gear 864 then meshes with a first spur portion 866*a* of a third compound gear 866. A second, smaller spur portion 866*b* of the third compound gear 866 then engages with a threaded spur gear 98 rotatably mounted on the central shaft assembly 90. The structure and operation of the threaded gear 98 will be described below.

Preferably, the transformation gear train 86 includes a slip clutch (unnumbered) on the third compound gear 866 in order to limit damage to the transformation gear train 86 and/or the third motor 87 if, during driving of the transformation gear train 86, the vanes 20 are stuck or otherwise prevented from rotating or manually forced to rotate about the second axes 20'. It is preferred that the third compound gear 866 have separate first and second spur portions 866*a*, 866*b* with engagement surfaces (e.g., serrated surfaces, not shown) therebetween. The second spur portion 866*b* is preferably biased toward the first spur portion 866*a* by a spring (unnumbered), so that, under normal conditions, the engagement surfaces prevent slippage between the first and second spur portions 866*a*, 866*b* to enable the third motor 87 to cause rotation of the threaded gear 98. However, if the vanes 20 become bound and prevent rotation of the threaded gear 98 during driving of the transformation gear train 86 by the third motor 87, the engagement surfaces between the first and second spur portion 866*a*, 866*b* slip with the second spur portion 866*b* being forced against the spring and away from the first spur portion 866*a*, thereby allowing the first spur portion 866*a* to continue rotating while also allowing the second spur portion 866*b* to not rotate. Although it is preferred that the slip clutch be included within the third compound gear 866, it is within the spirit and scope of the present invention for the slip clutch to be disposed in a different portion of the transformation gear train 86 or to be a different form of clutch. Such alternate clutches are generally well known in the art and need not be specifically described herein.

Figure 8:
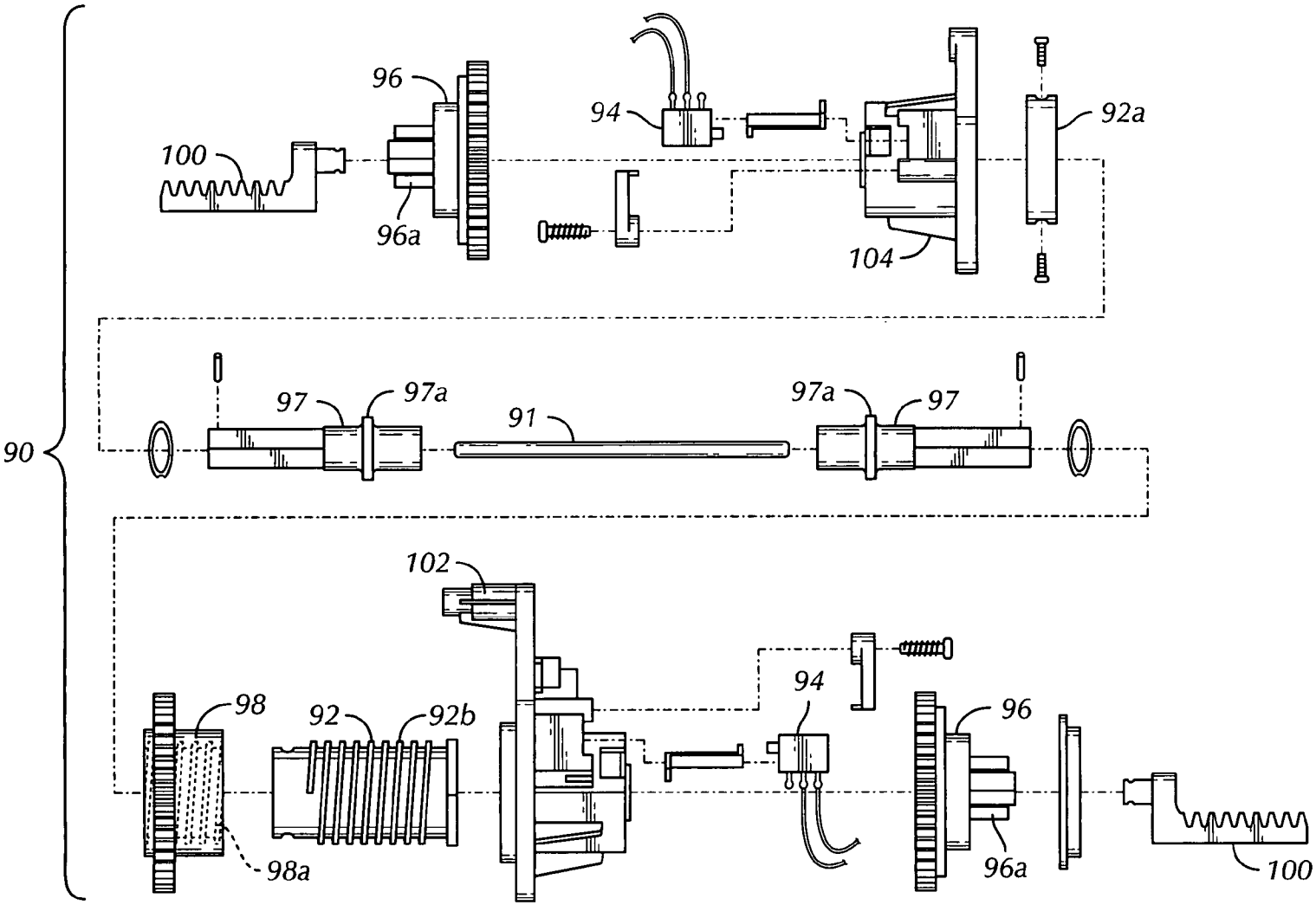
FIG. 8 is an exploded view of a central shaft assembly of the gear housing of FIG. 4.

Referring now to FIG. 8, the central shaft assembly 90 preferably includes a rod 91 having caps in the form of drive gear supports 97 rotatably disposed on either end of the rod 91. The rod 91 and drive gear supports 97 are disposed partially within a threaded tube 92, such that at least ends of the drive gear supports 97 extend outwardly from either end of the threaded tube 92. The rod 91 keeps flange portions 97*a* abutted against annular end walls (not depicted) of the threaded tube 92. The threaded gear 98, briefly discussed above, has internal threads 98*a* (partially shown in phantom) within a bore thereof for threadably engaging threads 92*b* on the outer surface of the threaded tube 92. A collar 92*a* engages an end of the threaded tube 92 to retain the threaded gear 98 on the threaded tube 92 and the drive gear supports 97 and rod 91 in the threaded tube 92.

The threaded gear 98 is essentially sandwiched between innermost first and second covers 102, 104 through which the threaded tube 92 is disposed when the gear housing 80 is assembled. The innermost first and second covers 102, 104 are engaged with the first and second portions 80*a*, 80*b*, respectively, of the gear housing 80. At least the ends of the drive gear supports 97 extend through the innermost first and second covers 102, 104 so that the drive gears 96 can be slidably disposed thereon in assembly so as to abut outer surfaces of the innermost first and second covers 102, 104.

Preferably, the drive gears 96 rotate with the drive gear supports 97, while at the same time being axially slidable with respect thereto. Preferably, this is accomplished by slidably keying the drive gears 96 with the drive gear supports 97, for example, by forming the ends of the drive gear supports 97 with a hexagonal cross-section and forming the drive gears 96 with a mating hexagonal bore, thereby allowing axial sliding movement of the drive gear supports 97 with respect to the drive gears 96 while rotationally fixing the drive gears 96 with the drive gear supports 97.

Engaged with the ends of the drive gear supports 97 and extending axially outwardly therefrom are rack gears 100. The central shaft assembly 90 further includes limit switches 94, preferably engaged with each of the innermost first and second covers 102, 104, which function to cut power to the third motor 87 when sliding limits of the central shaft assembly 90 are reached.

Generally speaking, the central shaft assembly 90 allows the rack gears 100, the drive gear supports 97, the rod 91, and the threaded tube 92 and collar 92*a* to move axially with respect to the drive gears 96, the threaded gear 98, and the innermost first and second covers 102, 104, as well as the gear housing 80 and the central housing 12. At the same time, the central shaft assembly 90 allows the drive gears 96 and the drive gear supports 97 to rotate separately and independently of each other without affecting the above-described axial motion. This is accomplished by retaining one drive gear 96 between the first portion 80*a* of the gear housing 80 and the innermost first cover 102, the other drive gear 96 between the second portion 80*b* of the gear housing 80 and the innermost second cover 104, and, as described above, the threaded gear 98 between the innermost first and second covers 102, 104, such that each can be rotated but cannot be moved axially with respect to the gear housing 80. The threaded tube 92, however, is able to move axially along the first axis 50' during rotation of the threaded gear 98, which causes the threads 98*a* of the threaded gear 98 to travel along the threads 92*b* of the threaded tube 92 during rotation of the threaded gear 98 by the transformation gear train 86. Because the threaded gear 98 is unable to move axially, it forces the threaded tube 92 to move axially along the first axis 50'. Doing so further causes the drive gear supports 97, the rod 91, and the rack gears 100 to move axially along the first axis 50'. However, regardless of the axial position of the above-listed components, the drive gears 96 are still capable of being rotated by the respective first and second drive gear trains 82, 84 in order to drive the first and second wheels 30, 40. In this way, the first and second wheels 30, 40 can be independently driven with the vanes 20 fixed in any vane position, e.g., any of the first, second, and intermediate positions 22, 24, 26 (as well as any other intermediate position), as well as during rotation of the vanes 20 between positions.

Figure 9:
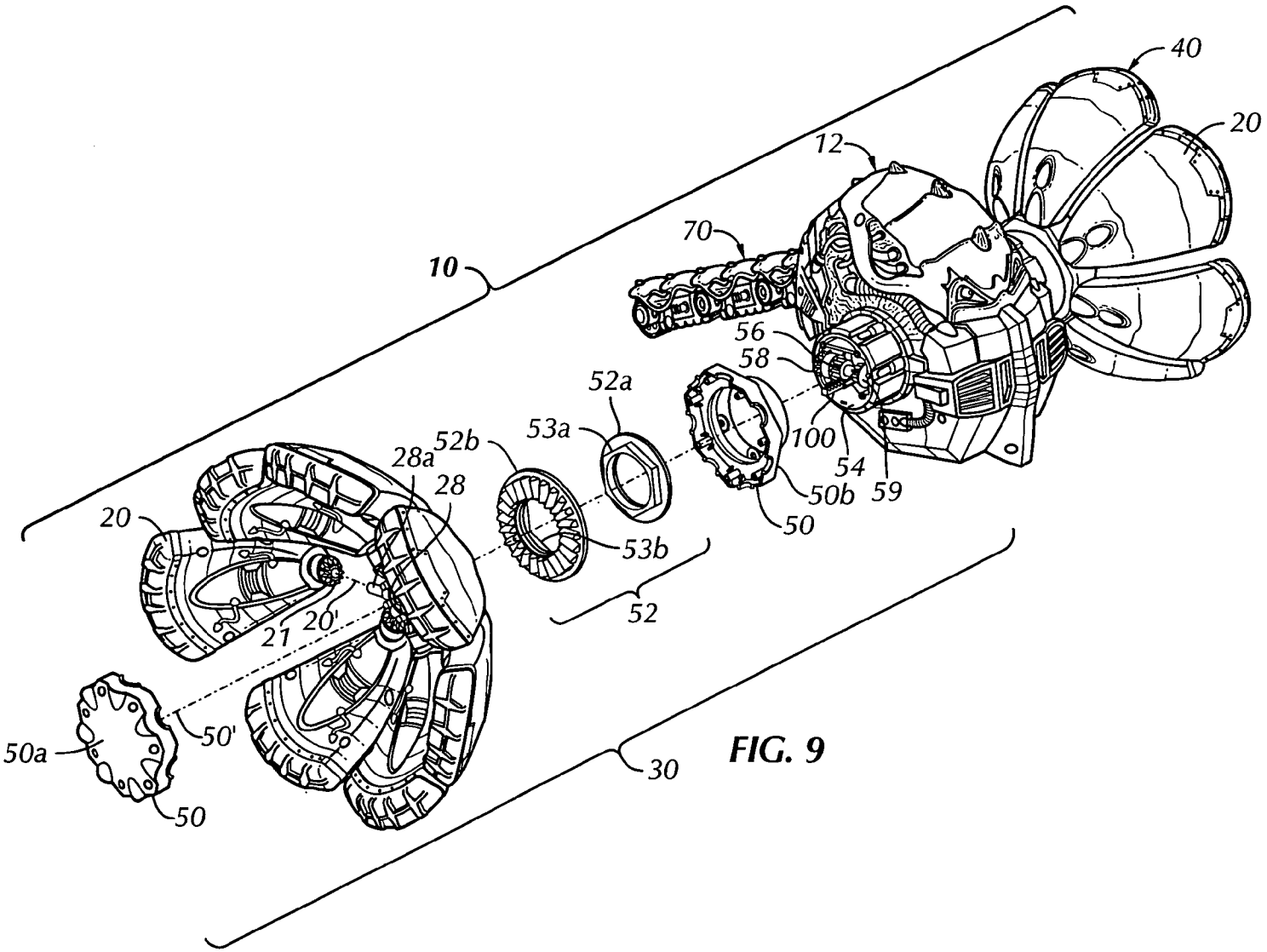
FIG. 9 is a front left perspective view of the toy vehicle of FIG. 2 having the first wheel partially exploded.
Figure 10:
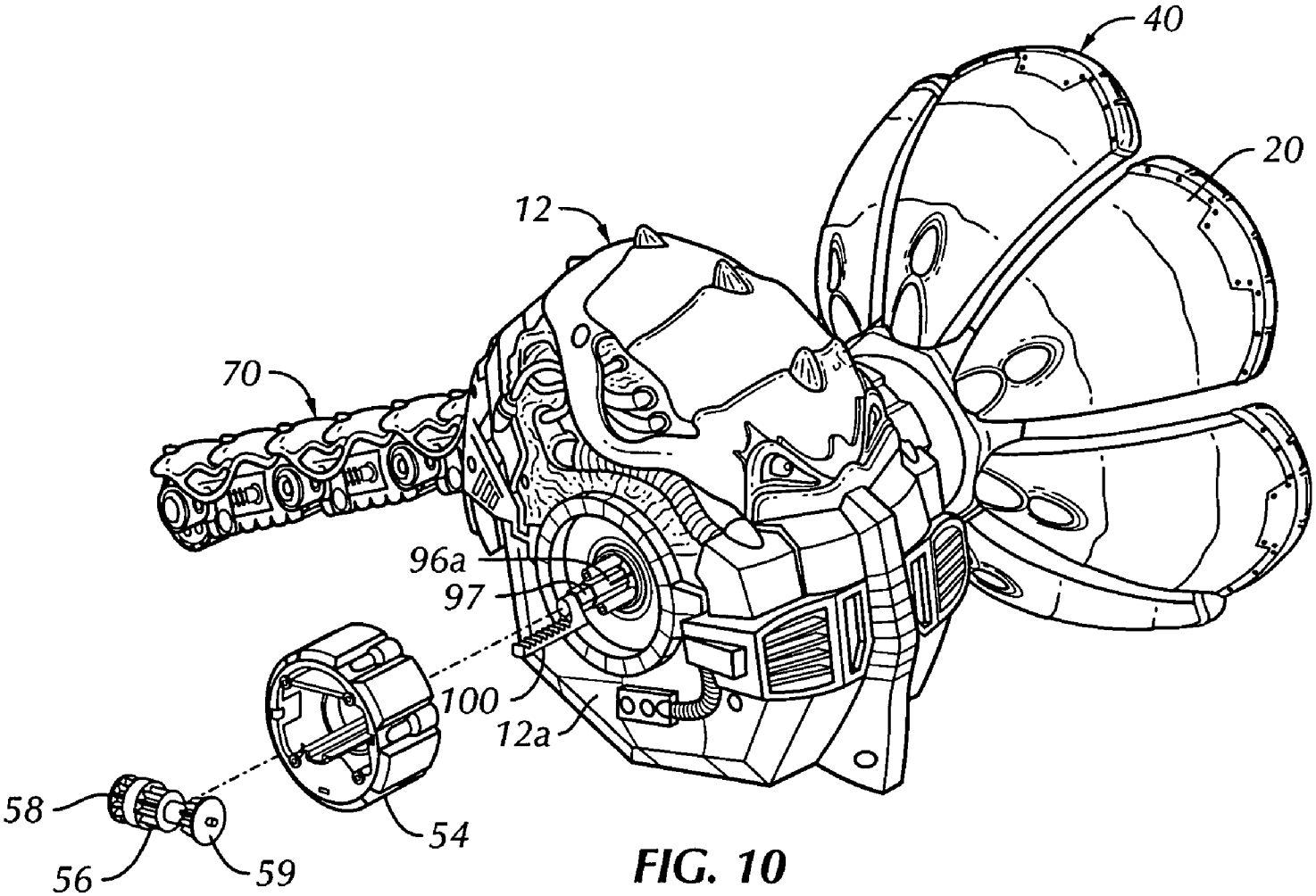
FIG. 10 is a front left perspective view of the toy vehicle of FIG. 9 having a portion of the first wheel omitted and the remaining portion of the first wheel exploded.

Referring now to FIGS. 9 and 10, a generally cylindrical collar 54 is preferably fixed to a distal end portion 96*a* of the drive gear 96 that extends outwardly from the first side 12*a* of the central housing 12 and the first portion 80*a* of the gear housing 80. Because the collar 54 is fixed to the drive gear 96, the collar 54 rotates with the drive gear 96. An inner portion 50*b* of the central hub 50 is fixed to the collar 54 and thus with the drive gear 96 so as to rotate therewith. The vanes 20 are preferably rotatably retained between the inner portion 50*b* and an outer portion or cover portion 50*a* of the central hub 50 so that the first wheel 30 and its vanes 20 rotate about the first axis 50' along with the central hub 50. In this way, driving of the first wheel 30 is accomplished. Although not separately described, driving of the second wheel 40 is accomplished in a similar manner.

Referring still to FIGS. 9 and 10, disposed within the collar 54 is a series of gears including a pinion 56 engaged with and rotatable by axial sliding motion of the rack gear 100. A driving spur gear 58 is engaged with the pinion 56 so as to rotate in the same direction therewith. A driven spur gear 59 is disposed on the other side of the pinion 56. The driven spur gear 59 is not rotatably engaged with the pinion 56. Disposed within the inner portion 50*b* of the central hub 50 is a compound crown gear 52. The compound crown gear 52 includes a first crown portion 52*a* and a second crown portion 52*b* engaged for rotation therewith by suitable means, such as a hexagonal boss 53*a* on the first crown portion 52*a* mating with a hexagonal recess 53*b* in the second crown portion 52*b*. The first crown portion 52*a* is driven by the driving spur gear 58 so as to rotate about the first axis 50' while permitting axial motion of the rack gear 100. This, in turn, causes the second crown portion 52*b* to also rotate about the first axis 50'. The second crown portion 52*b* engages with each of a plurality of vane gears 21, which are fixed to each vane 20 and also disposed within the central hub 50, captured between the outer and inner portions 50*a*, 50*b* of the central hub 50.

Preferably, each vane 20 is rotatably mounted on a post 28*a* (disposed along the second axis 20') of a wheel floret 28, also captured within the hub 50, such that rotation of the second crown portion 52*b* causes rotation of each of the vane gears 21 and, in turn, rotation of each vane 20 about its respective post 28*a*. In this way, when the rack gear 100 is moved axially along the first axis 50', each of the vanes 20 of the first wheel 30 is rotated in unison. Because the rack gear 100 associated with the second wheel 40 is also operatively coupled with the transformation gear train 86, it also slides axially along the first axis 50' to cause the vanes 20 of the second wheel 40 to rotate in unison with each other and with the vanes 20 of the first wheel 30. In this way, the toy vehicle 10 is capable of being transformed between a generally spherical shape with the vanes 20 in the first position 22 (FIG. 1) and a transformed shape with the vanes 20 in the second position 24 (FIG. 2).

Referring to FIG. 4, the toy vehicle 10 further includes an on-board control unit 16 operatively coupled with the first, second, and third motors 83, 85, 87 and configured to receive and process control signals transmitted from a remote, preferably wireless transmission source (e.g., a conventional, manually operated controller, not shown) spaced from the toy vehicle 10 to selectively remotely control operation of the first, second, and third motors 83, 85, 87, and, consequently, selectively control rotation and reconfiguration of the first and second wheels 30, 40. The on-board control unit 16 is preferably electrically powered, as are the first, second, and third motors 83, 85, 87. Preferably, a battery power source (not shown) disposed within a battery housing 14 supplies the electrical power needed to power the toy vehicle 10. Although it is preferred that the toy vehicle 10 be remotely controlled, it is within the spirit and scope of the present invention that the toy vehicle 10 be controlled in other ways, such as, but not limited to, programming of the toy vehicle 10 to move in a predefined manner. While first and second motors are preferred for independent wheel drive, in smaller variations of the invention, a single motor might be provided to drive both wheels simultaneously in a forward direction or in opposite directions when such motor is reversed. Similarly, while a third motor is used to axially move the central shaft assembly, the central shaft assembly might be moved in other ways, particularly in smaller versions of the invention. For example, a central shaft assembly might be moved electromagnetically between two extreme axial positions or spring biased toward one extreme axial position and driven against the bias toward an opposing extreme axial position.

In use, the toy vehicle 10 is driven on a surface by rotation of the first and/or second wheels 30, 40. The toy vehicle 10 can be transformed by causing the vanes 20 of the first and second wheels 30, 40 to rotate about the second axes 20' between the first position 22 in which the toy vehicle 10 is generally spherical in shape and the second position 24 in which the entire central housing 12 is exposed. Further, the tail 70 is able to be positioned in the extended position 74 or wrapped partially around the central housing 14 in the retracted position 72 with rotation of the central housing 12 caused by driving of the first and second wheels 30, 40. Although this is preferred, it is within the spirit and scope of the present invention that the tail 70 be powered so that it can be caused to move to the extended position 74 and back to the retracted position 72 independently from the driving of the first and second wheels 30, 40. The vanes 20 of the toy vehicle 10 can also be configured in the intermediate position 26 (FIG. 3), so that the first and second wheels 30, 40 resemble paddle wheels, or any other rotational position between the first and second positions 22, 24. If provided with buoyant vanes 20 and tail 70, the toy vehicle 10, otherwise sealed, can then be driven on the surface of water. Although intended to be driven on water when in the intermediate position 26, the toy vehicle 10 can also be driven on dry land with the vanes 20 in any intermediate position. Moreover, it is contemplated that the toy vehicle 10 can be driven on water with the vanes 20 in either of the first and second positions 22, 24, though not as effectively.

Although the manner described above for driving and transforming the toy vehicle 10 is preferred, it is not intended to be limiting. As such, it is within the spirit and scope of the present invention that alternate methods of driving and transforming the toy vehicle 10 are also contemplated, such as, but not limited to, those disclosed in previously incorporated U.S. Provisional Patent Application Nos. 60/622,037 and 60/642,060.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A toy vehicle, comprising:

a central housing having first and second oppositely disposed sides;

a first wheel rotatably mounted on the first side of the housing and a second wheel rotatably mounted on the second side of the housing, each of the first and second wheels having a central hub and a plurality of individual vanes rotatably attached to the hub, each hub having a center disposed along a first axis of rotation, each vane being rotatable about a second vane axis extending transversely with respect to the first axis, an end of each vane distal to the hub forming a circumferential surface portion of one of the first and second wheels.

2. The toy vehicle of claim 1, further comprising at least a first motor operatively coupled to at least the first wheel to drive at least the first wheel.

3. The toy vehicle of claim 2, further comprising at least a second motor operatively coupled to at least the second wheel to drive at least the second wheel.

4. The toy vehicle of claim 3, wherein the first motor is separately and independently operable from the second motor to separately and independently drive the first and second wheels.

5. The toy vehicle of claim 1, wherein the vanes of each wheel are rotatable simultaneously between a first position and a second position rotationally different from the first position.

6. The toy vehicle of claim 1, wherein the vanes are curved, such that, in a first rotational position of the vanes, the first and second wheels are generally cupped with open ends directed inwardly toward one another and, in a second rotational position of the vanes, the first and second wheels are generally cupped with the open ends directed outwardly away from one another.

7. The toy vehicle of claim 6, wherein the first and second wheels are generally hemispherical in the first and second rotational positions.

8. The toy vehicle of claim 6, wherein the vanes are selectively rotatable to provide at least one intermediate rotational position between the first and second positions.

9. The toy vehicle of claim 1, wherein the vanes of each of the first and second wheels are linked together so as to rotate in unison.

10. The toy vehicle of claim 1, further comprising a third motor operatively coupled to the vanes to rotate the vanes.

11. The toy vehicle of claim 10, further comprising an on-board control unit operatively coupled with the first, second, and third motors and configured to receive and process control signals transmitted from a remote source spaced from the toy vehicle to remotely control operation of the first, second, and third motors.

12. The toy vehicle of claim 1, further comprising a tail movably engaged with the housing, the tail having at least a first end and an oppositely disposed, free second end, the tail being movable between a retracted position and an extended position.

13. The toy vehicle of claim 12, wherein the first end of the tail is rotatably attached to the housing.

14. The toy vehicle of claim 13, wherein the tail is flexible, such that the tail, in the retracted position, is generally wrapped at least partially around the housing and, in the extended position, extends outwardly from the housing so that at least the second end is spaced from the housing.

15. The toy vehicle of claim 14, wherein the tail is formed by at least two articulated segments, such that a first segment is rotatably coupled to the housing and at least a second segment is rotatably coupled to the first segment.

16. The toy vehicle of claim 14, wherein the tail, in the retracted position, is disposed between open ends of the first and second wheels with the vanes in the first position.

17. The toy vehicle of claim 12, wherein the tail is buoyant in water.

18. The toy vehicle of claim 12, wherein the tail is made at least partially from a plastic foam material.

19. The toy vehicle of claim 12, wherein the tail includes at least one tail wheel proximate the second end for contacting a surface in at least the extended position of the tail.

20. The toy vehicle of claim 1, wherein the vanes are buoyant in water.

21. The toy vehicle of claim 1, wherein the vanes are made at least partially from a plastic foam material.

22. A transformable toy vehicle for movement on a surface, the toy vehicle comprising:

a housing;

at least two reconfigurable wheels mounted on the housing for rotation about a common axis extending through the housing, rotation of the wheels causing the toy vehicle to move on the surface, wherein each of the two wheels has at least a first configuration in which the wheel is generally shaped to receive and surround a portion of the housing adjoining the wheel and at least a second configuration different from the first configuration; and a tail movably engaged with the housing, the tail having at least a first end and an oppositely disposed, free second end, the tail being movable between an extended position with at least the free end extending beyond an imaginary cylinder having a cross-section defined by circumferential perimeters of the two wheels in all possible configurations of the two wheels and a retracted position with the free end closer to the housing:

wherein, in the second configuration, each wheel is generally cupped and has an open end generally extending outwardly from the housing.

23. The transformable toy vehicle of claim 22, wherein the wheels are generally hemispherical in at least one of the first and second configurations.

24. The transformable toy vehicle of claim 23, wherein the wheels have at least an intermediate third configuration in which the wheels are converted into paddle wheels to facilitate travel of the toy vehicle on water.

25. The toy vehicle of claim 24, wherein the wheels are buoyant in water.

26. The toy vehicle of claim 24, wherein the wheels are made at least partially from a plastic foam material.

27. The toy vehicle of claim 22, wherein the first end of the tail is rotatably attached to the housing.

28. The transformable toy vehicle of claim 22, further comprising an on-board control unit operatively coupled with the wheels and configured to receive and process control signals transmitted from a remote source spaced from the toy vehicle to remotely control rotation and reconfiguration of the wheels.

29. A transformable toy vehicle for movement on a surface, the toy vehicle comprising:

a housing;

at least two reconfigurable wheels mounted on the housing for rotation about a common axis extending through the housing, rotation of the wheels causing the toy vehicle to move on the surface, wherein each of the two wheels has at least a first configuration in which the wheel is generally shaped to receive and surround a portion of the housing adjoining the wheel and at least a second configuration different from the first configuration; and a tail movably engaged with the housing, the tail having at least a first end and an oppositely disposed, free second end, the tail being movable between an extended position with at least the free end extending beyond an imaginary cylinder having a cross-section defined by circumferential perimeters of the two wheels in all possible configurations of the two wheels and a retracted position with the free end closer to the housing;

wherein the first end of the tail is rotatably attached to the housing; and wherein the tail is flexible, such that the tail, in the retracted position, is generally wrapped at least partially around the housing and, in the extended position, extends outwardly from the housing so that at least the second end is spaced from the housing.

30. The transformable toy vehicle of claim 29, wherein the tail is formed of a plurality of articulated tail segments.

31. The transformable toy vehicle of claim 30, wherein, with the tail in the retracted position and the wheels in the first configuration, the tail is disposed between the wheels, such that the toy vehicle is generally ovular in shape.

32. A transformable toy vehicle for movement on a surface, the toy vehicle comprising:

a housing;

at least two reconfigurable wheels mounted on the housing for rotation about a common axis extending through the housing, rotation of the wheels causing the toy vehicle to move on the surface, wherein each of the two wheels has at least a first configuration in which the wheel is generally shaped to receive and surround a portion of the housing adjoining the wheel and at least a second configuration different from the first configuration; and a tail movably engaged with the housing, the tail having at least a first end and an oppositely disposed, free second end, the tail being movable between an extended position with at least the free end extending beyond an imaginary cylinder having a cross-section defined by circumferential perimeters of the two wheels in all possible configurations of the two wheels and a retracted position with the free end closer to the housing;

wherein the tail is constructed so as to be buoyant in water.

33. A transformable toy vehicle for movement on a surface, the toy vehicle comprising:

a housing;

at least two reconfigurable wheels mounted on the housing for rotation about a common axis extending through the housing, rotation of the wheels causing the toy vehicle to move on the surface, wherein each of the two wheels has at least a first configuration in which the wheel is generally shaped to receive and surround a portion of the housing adjoining the wheel and at least a second configuration different from the first configuration; and a tail movably engaged with the housing, the tail having at least a first end and an oppositely disposed, free second end, the tail being movable between an extended position with at least the free end extending beyond an imaginary cylinder having a cross-section defined by circumferential perimeters of the two wheels in all possible configurations of the two wheels and a retracted position with the free end closer to the housing;

wherein the tail is made at least partially from a plastic foam material.

34. A transformable toy vehicle for movement on a surface, the toy vehicle comprising:

a housing;

at least two reconfigurable wheels mounted on the housing for rotation about a common axis extending through the housing, rotation of the wheels causing the toy vehicle to move on the surface, wherein each of the two wheels has at least a first configuration in which the wheel is generally shaped to receive and surround a portion of the housing adjoining the wheel and at least a second configuration different from the first configuration; and a tail movably engaged with the housing, the tail having at least a first end and an oppositely disposed, free second end, the tail being movable between an extended position with at least the free end extending beyond an imaginary cylinder having a cross-section defined by circumferential perimeters of the two wheels in all possible configurations of the two wheels and a retracted position with the free end closer to the housing;

wherein the tail includes at least one tail wheel proximate the second end for contacting a surface in at least the extended position of the tail.

35. A transformable toy vehicle for movement on a surface, the toy vehicle comprising:

a housing;

at least two reconfigurable wheels mounted on the housing for rotation about a common axis extending through the housing, rotation of the wheels causing the toy vehicle to move on the surface, wherein each of the two wheels has at least a first configuration in which the wheel is generally shaped to receive and surround a portion of the housing adjoining the wheel and at least a second configuration different from the first configuration; and a tail movably engaged with the housing, the tail having at least a first end and an oppositely disposed, free second end, the tail being movable between an extended position with at least the free end extending beyond an imaginary cylinder having a cross-section defined by circumferential perimeters of the two wheels in all possible configurations of the two wheels and a retracted position with the free end closer to the housing;

wherein the wheels are buoyant in water.

36. The transformable toy vehicle for movement on a surface, the toy vehicle comprising:

a housing;

at least two reconfigurable wheels mounted on the housing for rotation about a common axis extending through the housing, rotation of the wheels causing the toy vehicle to move on the surface, wherein each of the two wheels has at least a first configuration in which the wheel is generally shaped to receive and surround a portion of the housing adjoining the wheel and at least a second configuration different from the first configuration; and a tail movably engaged with the housing, the tail having at least a first end and an oppositely disposed, free second end, the tail being movable between an extended position with at least the free end extending beyond an imaginary cylinder having a cross-section defined by circumferential perimeters of the two wheels in all possible configurations of the two wheels and a retracted position with the free end closer to the housing;

wherein the wheels are made at least partially from a plastic foam material.

* * * * *